US007677822B2

(12) United States Patent
Topani

(10) Patent No.: US 7,677,822 B2
(45) Date of Patent: Mar. 16, 2010

(54) SEMIAUTOMATIC ELECTRONIC PRINTER

(75) Inventor: Fabio Topani, Rome (IT)

(73) Assignee: NESTOR s.c.a.r.l., Rome (IT)

( * ) Notice: Subject to any disclaimer, the term of this patent is extended or adjusted under 35 U.S.C. 154(b) by 833 days.

(21) Appl. No.: 10/587,024

(22) PCT Filed: Feb. 15, 2005

(86) PCT No.: PCT/IT2005/000074

§ 371 (c)(1),
(2), (4) Date: Jul. 24, 2006

(87) PCT Pub. No.: WO2005/077660

PCT Pub. Date: Aug. 25, 2005

(65) Prior Publication Data

US 2009/0185847 A1 Jul. 23, 2009

(30) Foreign Application Priority Data

Feb. 16, 2004 (IT) ..... RM2004A0083

(51) Int. Cl.
*B41J 3/36* (2006.01)

(52) U.S. Cl. ..... 400/88; 346/143; 347/109

(58) Field of Classification Search ..... 400/88; 347/109; 346/143
See application file for complete search history.

(56) References Cited

U.S. PATENT DOCUMENTS 5,063,451 A 11/1991 Yanagisawa et al.
5,634,730 A 6/1997 Bobry et al.
6,991,332 B1 * 1/2006 Fan et al. ..... 347/109
2001/0024586 A1 9/2001 Day et al.
2003/0106447 A1 6/2003 Walling

FOREIGN PATENT DOCUMENTS

DE 40 23 520 A1 2/1991
EP 0 598 251 A 5/1994

OTHER PUBLICATIONS

International Search Report of PCT/IT2005/000074, mailed Aug. 10, 2005.

* cited by examiner

*Primary Examiner*—Leslie J Evanisko
(74) *Attorney, Agent, or Firm*—Nixon & Vanderhye P.C.

(57) ABSTRACT

A semiautomatic electronic printer comprises a housing (2) and, internally, a print head (8). A push-button (3), projecting upwards from the housing (2), is rigidly connected to a frame (7), which is mounted in a spring-charged relationship inside the housing (2) in such a manner to be vertically movable between a rest position and a working one. The frame (7) sustains in the upper part a printed circuit board including a microprocessor for acquiring from a separate computer data that has to be printed, and for storing such data, as well as for controlling the operation of the print head (8), supported by a carriage (20), with its inferior part being brought to touch the medium to be printed when the push-button is pushed downwards and to translate horizontally after the printing of a line of dots until a desired imaging made of a dot matrix has been printed on the all printing surface.

15 Claims, 6 Drawing Sheets

SEMIAUTOMATIC ELECTRONIC PRINTER

This application is the US national phase of international application PCT/IT2005/000074, filed 15 Feb. 2005, which designated the U.S. and claims priority of IT RM2004A000083, filed 16 Feb. 2004, the entire contents of each of which are hereby incorporated by reference.

TECHNICAL FIELD

The present invention relates to a semiautomatic electronic printer.

BACKGROUND ART

Electronic printers, as described, for example, by documents U.S. Pat. No. 4,949,283, U.S. Pat. No. 5,634,730, PCT/SE01/01575, and PCT/AU03/00168, are already known.

From a general point of view, said electronic printers have in common a print head operable by a manual print control on a medium to be printed, an external housing being comfortable for a hand gripping, communication means for coupling the print head with an electronic apparatus such as a computer, and position detecting means adapted to detect the position of the print head.

The above mentioned printers are rough in the movement and positioning of the print head. Further, they require a manual operation by a user that moves the print head on the medium to be printed by pressing the print control.

In order to better illustrate the background of art, U.S. Pat. No. 5,634,730 is particularly considered, which discloses a hand-held electronic printer having a housing that can be manually positioned on a surface of the medium to be printed and remain stationary during a print sequence. The housing has an aperture that generally defines a printing area on the medium. A printing device is disposed in the housing and comprises a print head that, under the control of an actuator, is moved from an initial position to a final position to perform the printing operation. A spring is operatively connected to the print head to return the same to the initial position. Electronic control means are disposed in the housing to synchronise the printing in relation with the movements of the print head.

In the specification of U.S. Pat. No. 5,634,730 it is often said that its object is to make the electronic printer similar to a conventional mechanical stamper, in which the rubber marker is manually lowered in vertical direction up to the surface of the medium to leave a desired mark. However, the printer according to U.S. Pat. No. 5,634,730 does not perform really the operation of a traditional stamper, since the force that is exerted by the user on the actuator does not bring the print head near to the medium, as the print head is always close to the medium, but it produces an horizontal movement of the print head to perform the printing operation. On the contrary, a spring acting against the actuator, besides giving to the user a similarity impression with the action exerted on a conventional mechanical stamper, serves to bring the print head back to its initial position.

It can be appreciated that in all the patents cited the relevant printing apparatuses do not allow a user to select with precision the zone on which he or she desires to print. Firstly, because it is the user who has to displace very approximately the printer, as he or she cannot see the zone to be printed underneath the printer. Secondly, because the user cannot reasonably estimate a travel of the print head to adjust the printing operation on the desired zone of the medium.

Thus, an object of the present invention is to make an electronic printer that functions exactly as a mechanical stamper in the way in which a print head is brought near to a medium to be printed.

Another object of the invention is to permit a precise printing on the desired zone of the medium independently of the precision of the operation of the user.

A further object of the invention is to allow a working position of the print head to be maintained independently of maintaining the force exerted by the user on the actuator until the printing operation is completed.

Yet another object of the invention is to permit the choice of the printing resolution that the user wants to obtain.

Another object of the invention is to allow the user to see the impression zone of the printer, i.e. the zone where the printing is performed, also when the printer is positioned in the printing zone.

DISCLOSURE OF THE INVENTION

In order to achieve the objects above mentioned, the present invention provides a semiautomatic electronic printer, comprising a housing that can be positioned on the surface of a medium to be printed and remain stationary during a print sequence, a large push-button located in the upper part of the housing and movable with respect to same housing, a print head being provided with proper printing means and positioned inside the housing, and electronic control means disposed in the housing and adapted to acquire data to be printed from a separated computer and to store such data, as well as adapted to control the operation of the print head, the printer comprising, as a moving unit inside the housing, a push-button; at least a switch for controlling the printing, disposed on said moving unit and activated by the movement of the moving unit with respect to the housing; a frame, being rigidly connected to said push-button and mounted, in a spring-charged relationship, inside said housing in such a manner to be vertically movable between two positions, the one being upper or rest position and the other being lower or work position, such lower position being reached and maintained at least for the time necessary to execute the printing operation; a powered carriage, sustained, in its upper part, by said frame and adapted to transport a print head for a predefined printing travel, and controlled by electronic control means; a print head, rigidly connected to said carriage with its printing means being disposed in the lower part and brought to touch said medium to be printed in the printing operation; and a printed circuit board sustained in its upper part by said frame, including said electronic control means.

BRIEF DESCRIPTION OF DRAWINGS

The present invention will be described with reference to its preferred embodiment in connection with the enclosed drawings, in which.

DESCRIPTION OF A PREFERRED EMBODIMENT

Figure 1:
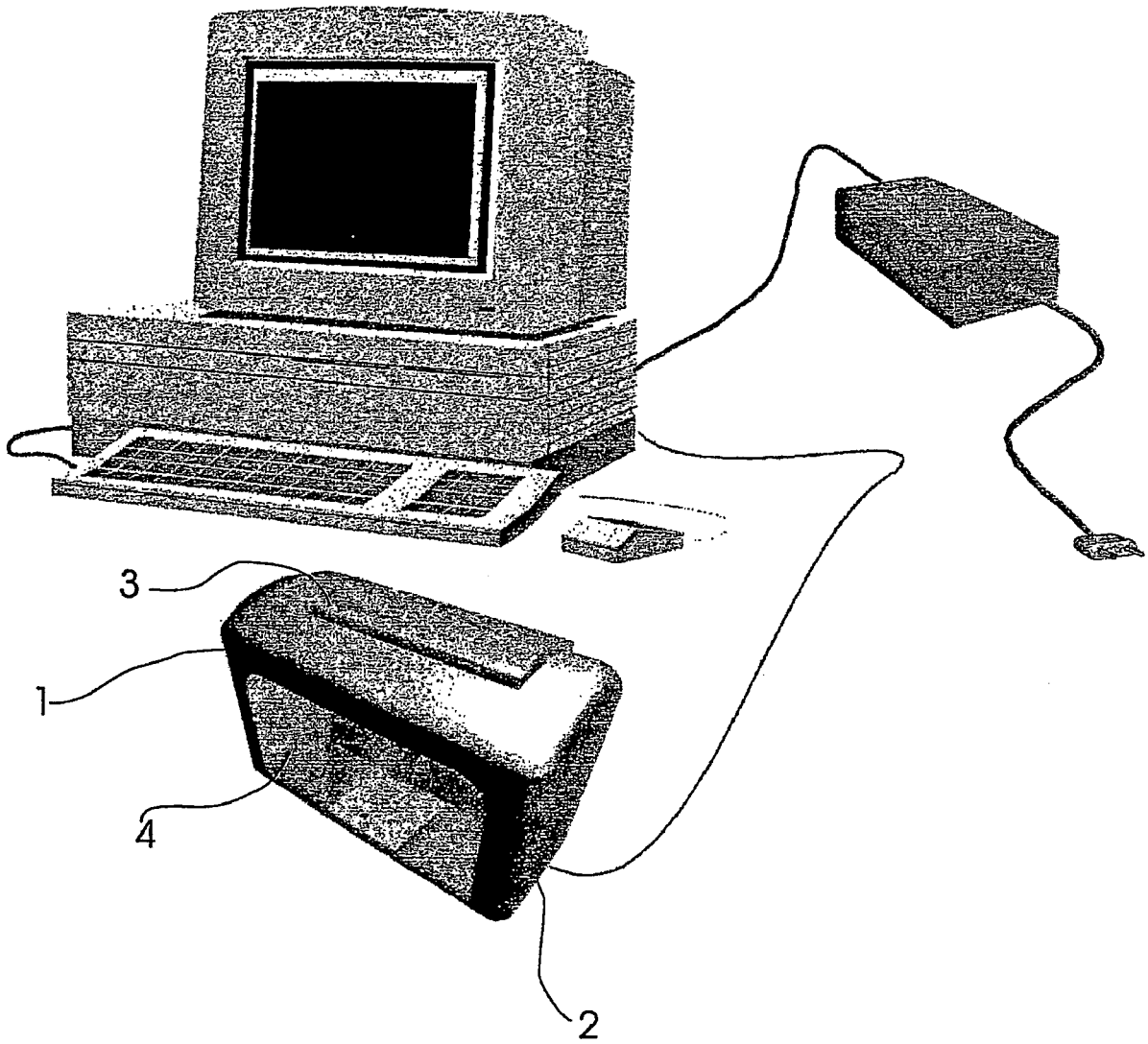
FIG. 1 shows in a diagrammatic perspective view a printer according to the present invention connected to a computer.

Referring to the drawings, in FIG. 1 a semiautomatic electronic printer 1 according to the invention is shown as connected to a properly power on personal computer. Data to be printed through an interface transceiver in the printer, for example a RS232 serial line, are received in a known way. The printer 1 has a housing 2 and, in the upper part, a large push-button 3. Suitably the housing 2 comprises at least a frontal transparent window 4 in order to permit that the printing operation can be watched.

Figure 4:
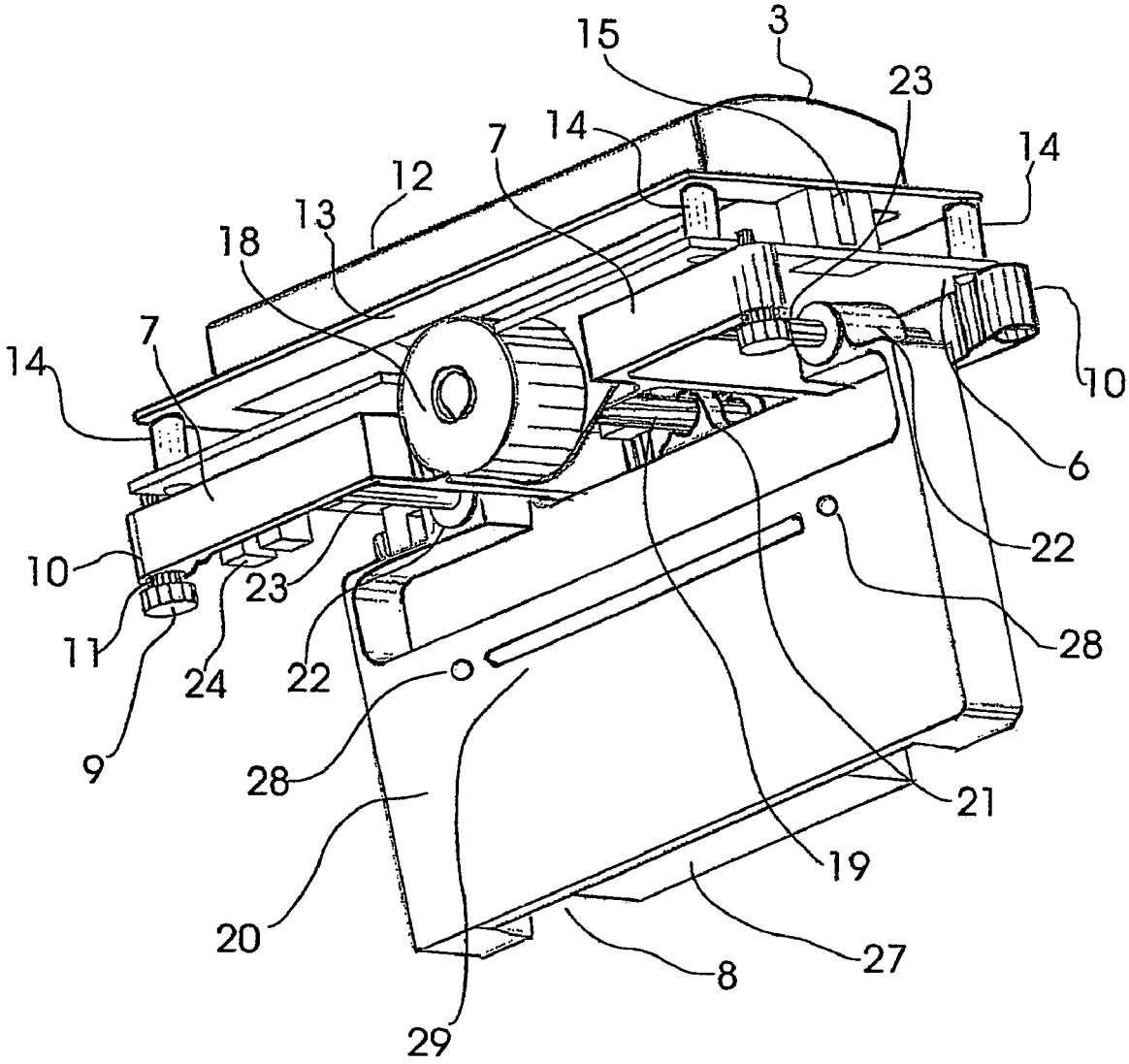
FIGS. 4 and 5 show perspective views from both sides of a moving unit of the printer according to the invention.
Figure 5:
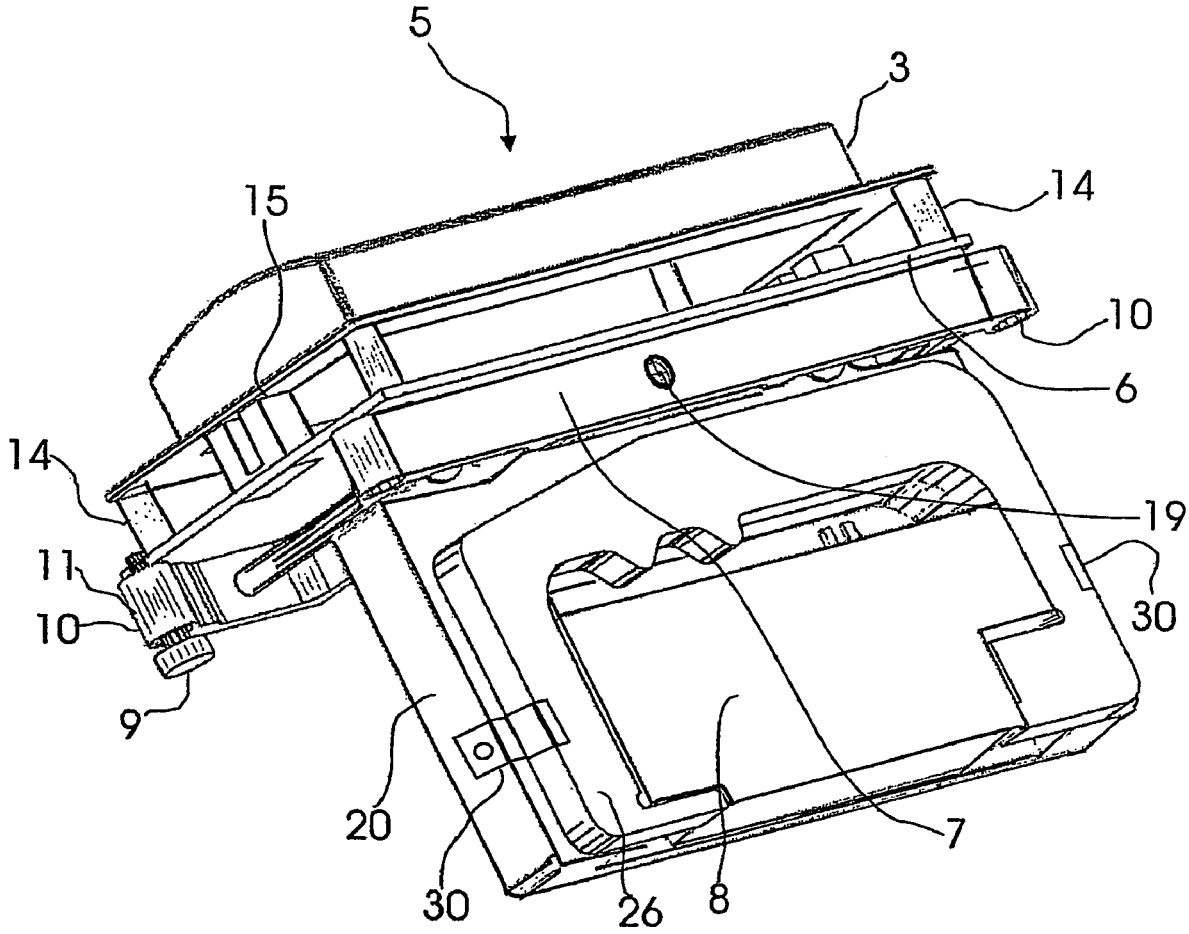

As one can see, the housing 2 is ergonomic and is able to be comfortably gripped and positioned on a surface to be stamped and to remain stationary for a complete printing sequence. The push-button 3, which is located on the upper part of the housing 2, is movable with respect to the same housing. The push-button 3 and the moving unit 5, of which the push-button 3 is a part, are best shown in FIGS. 4 and 5 that are perspective views taken from the back and from the front, respectively. The moving unit 5 comprises, besides the push-button 3, a printed circuit board 6, containing electronic components of the printer, a frame 7, a print head 8 with relevant horizontal traverse means, as it will be explained below.

Figure 2:
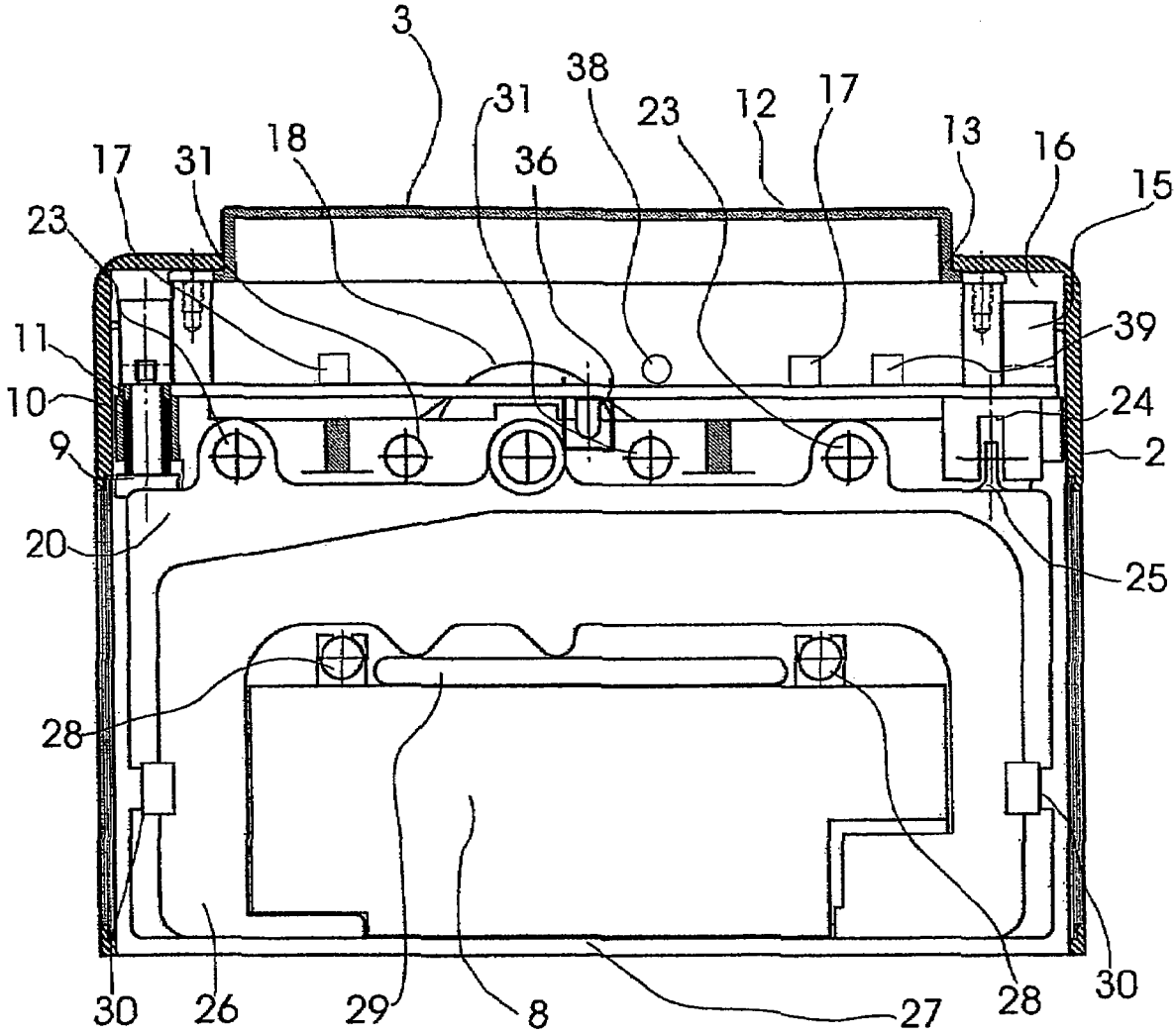
FIG. 2 shows a longitudinal section view of a printer according to the invention.
Figure 3:
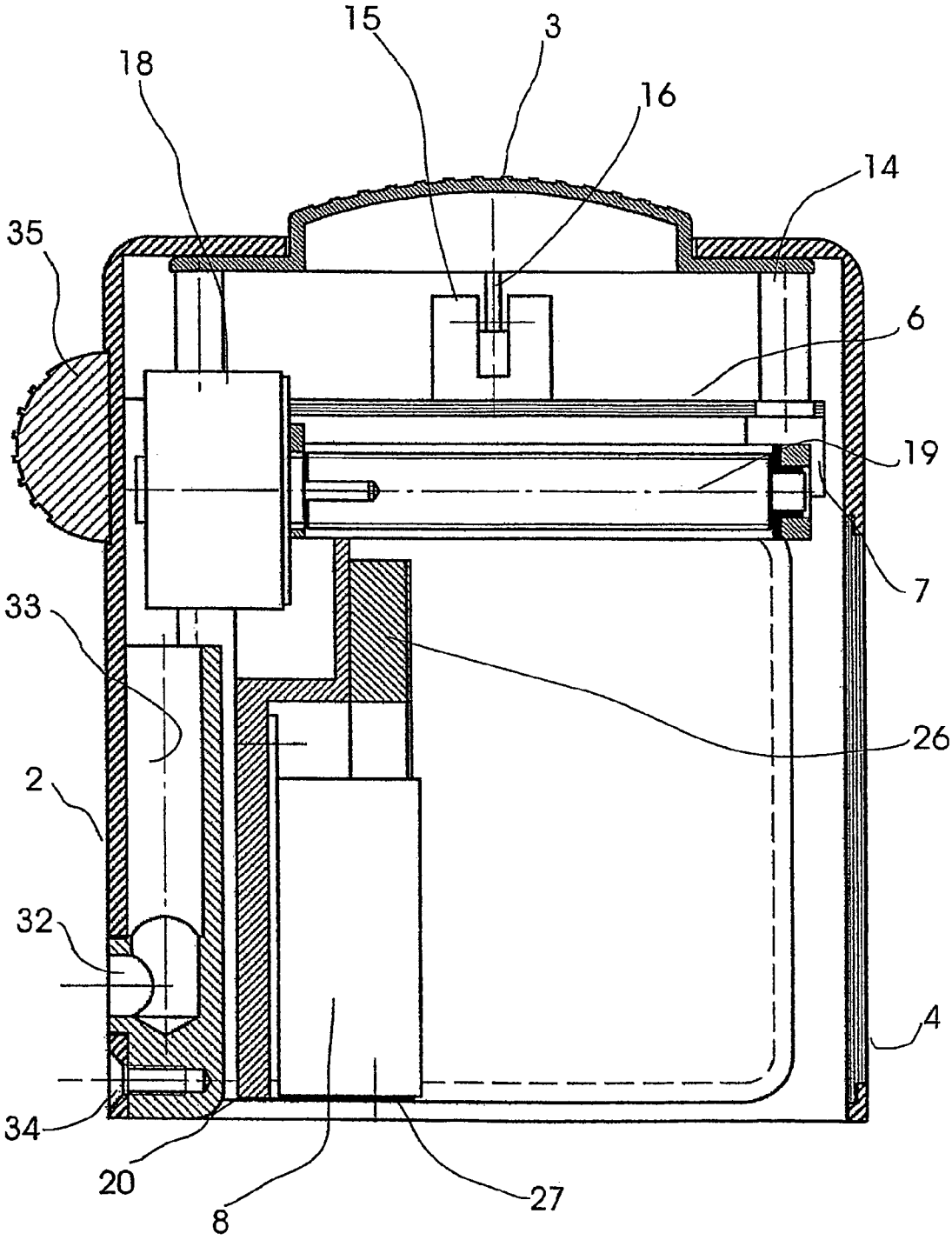
FIG. 3 shows a cross-section view of the printer in FIG. 2.

The moving unit 5 is mounted in the housing 2, as best shown in FIGS. 2 and 3, which are a longitudinal section view and a cross-section view, respectively, of the semiautomatic electronic printer according to the invention. The moving unit 5 is mounted in the housing 2 by four supporting screws with collar, which are generally indicated as 9 and can be screwed at four internal comers of the housing 2. The screws 9 comprise a cylindrical head, a smooth body without thread and an end section, the latter having a diameter less than that one of the smooth body and being provided of a thread (FIGS. 2, 4, and 5). The screws 9 support the frame 7 at its four free ends, which are provided with bushings 10. Inside the bushings 10 respective helical springs 11 are placed that withstand a sliding stroke of the frame on the four screws 9. The greater diameter of the smooth body in the screws 9 represents an abutment for their screwing. Therefore, the screws 9 constitute a firm guide for the sliding of the frame 7. The push-button 3 is made preferably of a semitransparent plastic material and has a vault portion 12 on a base 13 with a rectangular frame. The base 13 is fixed by screws to spacers 14, which separate the base 13 from the printed circuit board 6. The printed circuit board contains electronic control means for acquiring data to be printed from the separated computer, and for storing such data, as well as for controlling the operation of the print head.

Disposed on the printed circuit board is at least a first fork sensor 15 (it is preferable, one fork sensor on each side of the printed circuit board), which is adapted to detect the movement of the moving unit with respect to the housing of the printer. The fork sensor 15 forms an optoelectronic switch by interacting with a relevant small flag 16 shown in FIG. 3. The small flag 16 is made rigidly connected to the housing 2 in a predetermined position that will be clear in the following. Such an optoelectronic switch and relevant small flag can be replaced by a magnetic sensor and relevant magnet, or furthermore by a mechanical switch and its switching element.

The printed circuit board 6 is sustained by the frame 7. The frame 7 has a structure having at its four corners the bushings 10 designed to accommodate the collar screws 9 with interposition of respective springs 11. As shown in FIG. 4, the frame 7 is recessed in order to receive a motor 18, fixed by screws 31. The motor 18 is designed to translate a carriage 20 sustaining the print head 8. The shaft of the motor 18 supports a transmission by a worm screw 19 whose nut screw 21 is connected to the carriage 20. The carriage 20 has two sleeves 22 designed to slide on guides 23. The guides 23 are mounted transversally to the frame 7, suitably on both the sides of the worm screw 19. The worm screw transmission is provided only by way of example, and other driving systems can be designed instead of its.

Mounted under the printed circuit board 6 are other two fork sensors 24 whose small flag 25 (FIG. 2) is fixed on the carriage 20. The purpose of this arrangement is to detect when the carriage has arrived at end positions of its admissible travel. Opposite to the motor 18 the frame 7 supports the motor shaft with the worm screw 19. The print head 8 is sustained by the carriage 20. Preferably, the print head 8 is that one of a dot printer, for example Epson M190, which is modified through the removal of the platen as needle or wire abutment and the relevant mechanical parts. Instead of the platen and other provision is made of an inked tape cartridge 26 suitably made to permit the operation of the modified print head, i.e. the cartridge 26 is so mounted that the tape passes between the needles, as printing means, and the surface of the zone to be printed (not shown) underneath a lower portion of the print head, lower portion that is diagrammatically indicated as 27. As shown in FIGS. 2 and 4, the print head is fixed to the carriage by means of screws 28. Further, a slot 29 is performed in the carriage 20 as a passageway of electric cables (not shown) that connect the print head to the printed circuit board. The tape cartridge 26 is retained by clips 30 on the carriage 20.

The operation of the print head 8 is managed by a microprocessor inside the printer housing, which is located on the printed circuit board 6. The microprocessor acts as electronic control means. As said above, the print head is of a type available on the market, that is adapted to be used on the printer of the present invention. As such, said print head can be replaced by other print heads with relevant ink tapes.

With reference to FIG. 3, a hole 32 is shown close to the housing 2 in the right-hand side in the figure. The hole 32 is provided for a cable from the computer. Further, in order to lock and guide inside the housing the cable, provision is made of a sleeve 33 fixed to the housing by a screw 34. Alternatively, a connector can be fitted in the hole 32, if suitably shaped. A gripping handle 35 is provided outside the housing in order to help the user to keep pushed down the button 3 of the printer.

Disposed on the printed circuit board 6 are displays, such as multicolour LEDs 17 for example, which serve to illuminate the vault 12 of the push-button so that the status of operation of the printer is shown by different colours. There are other LEDs, such as that indicated as 36 in FIG. 2, facing downwards in order to illuminate the printing zone. Further, on the printed circuit board there is an inclinometer 38, which allows the user to check the horizontal position of the electronic printer. A horn is diagrammatically indicated as 39 in FIG. 2. Further, on the printed circuit board there is a sensor detecting the presence of the inked cartridge.

According the construction above described the push-button 3 is rigidly connected to the frame 7, which is mounted, in a spring-charged relationship, inside the housing 2.

In this way the frame 7 is vertically movable between two positions, the one being upper or rest position and the other being lower or work position. The lower position is reached and maintained for all the time in which a manual force is exerted to the push-button against the bias of the counteracting springs 11. Without the manual force the springs 11 bring the push-button back to the rest position.

Figure 6:
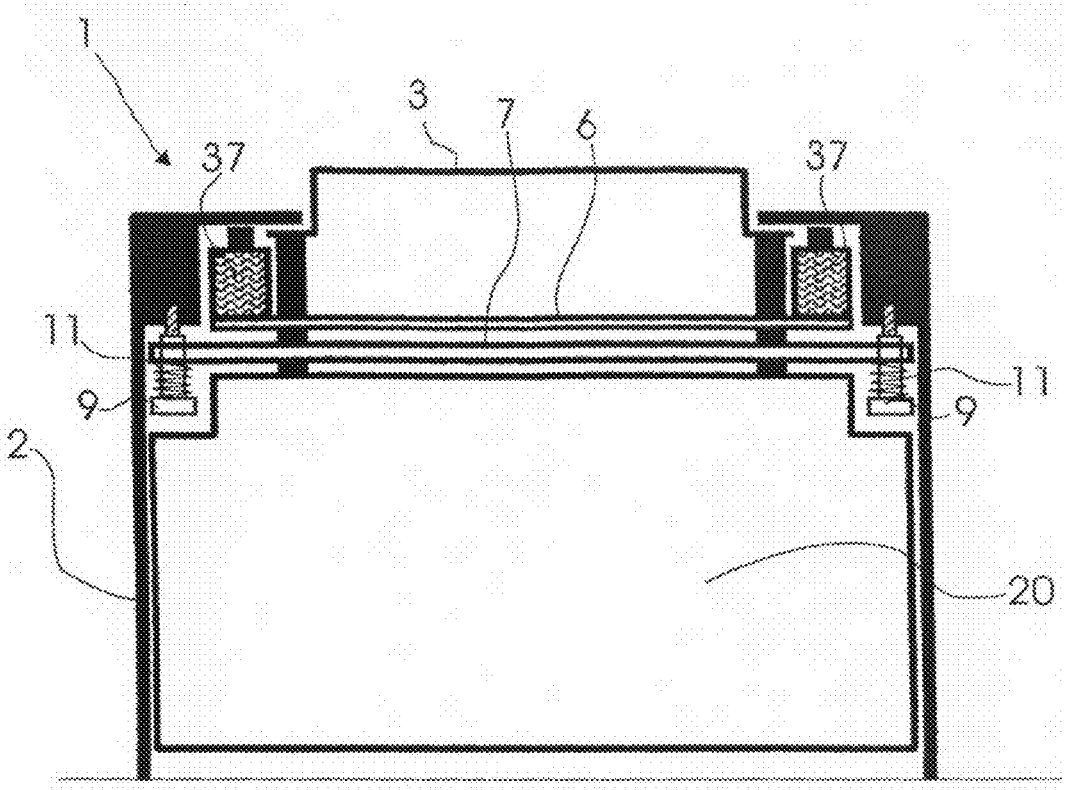
FIGS. 6 and 7 show frontal views of a modified movement of the moving unit of the printer according to the invention.
Figure 7:
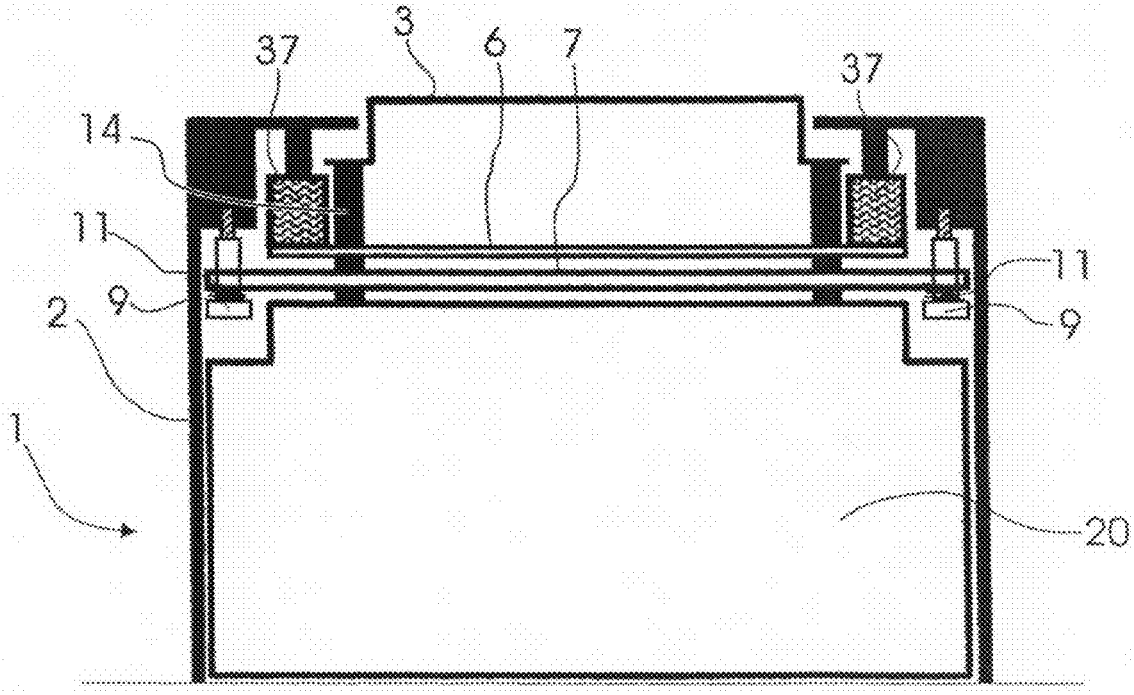

Alternatively, as shown in the diagrammatic front views of FIG. 6 (rest position) and 7 (work position), on the printed circuit plate 6 provision is made of at least one electromagnet (two, indicated as 37, in FIGS. 6 and 7), able to exert a balanced force against the bias of the counteracting springs 11. Without said balanced force, the counteracting springs 11 bring the push-button 3, and the rest of the moving unit 5 associated thereto, back to the rest position shown in FIG. 6.

The operation of the printer is as follows. After power on, the initialisation of internal resources of the microprocessor of the printer, the initialisation of the serial line, the initialisation of LEDs and the positioning of the carriage in a start or home position occur. Then, the microprocessor cyclically performs through the serial line a check of reception of controls or data from the external computer, then performs a check of the pressure on the push-button through the opto-electronic sensors 15, 16, further performs a check of the correct work position by means of the inclinometer and of the sensor of presence of inked cartridge. This information updates continuously the internal status of the printer without causing any action, at the beginning.

At this moment, it must be said that the operative way of the printer can be different depending on its ways of use. In summary, in a first way of use the printing begins with the pressure on the push-button, provided that there is the inked cartridge and the printer is in work position. The image that was stored last or was locally processed by the microprocessor will be printed.

In a second way of use the computer, asking the status of the printer and checking the request of the user who has pressed the push-button, sends data that the printer has to print and the relevant printing control, after considering properly the information about the presence of the tape and the operative position.

In a third way of use, for example, the computer can send data and printing control independently of the request of the user, and then of the pressure of the push-button. In this case the computer sends also the control of excitation of the electromagnets in order to cause the print head to approach the surface to be print. This last way is particularly advantageous in automatic process of stamping.

In the case the push-button is pressed by the user, the movement downwards of the push-button causes light to pass through the fork of the sensor(s) 15, being no longer covered by the small flag 16 fixed to the housing, and the printing operation is activated. The latter comprises the activation of the carriage motor, the data retrieval from the memory and the data format suitably to the print head. Using the print head above cited, the printing is made by rows, whose data must be presented to the print head properly and synchronously with the movement of the carriage. The printing finishes when all the printing data has been used, or if the carriage has reached the end of its travel, i.e. of the printing zone, or because the user does not exert more the pressure on the push-button, or because the time for the printing is expired. The latter occurs if the travel of the carriage is obstructed. When the printing is finished, the carriage is positioned again in its initial position and is arranged to begin a new printing.

During the printing operation, any irregularity is signalled optically on the push-button, or, in case, also in an acoustic way in the room, and causes the updating of the status information of the printer inside the microprocessor, that can be required in any moment by the external computer.

The printer according to the present invention has many advantages. The printing method is a matrix printing with a progress of lines formed by points, which permits a high speed, graphic printing. The use of the dot printing allows to impress a stamp also on a medium underneath if the upper medium is copying. The upper transparent push-button is illuminated by different colours to signal to the user the operative status of the system. The whole of housing and moving unit is very compact, so that the printer has very small sizes. The motor goes ahead with a right pitch to make a printing line with consequent complete graphical abilities. The printing quality is good. The printer needs a minimum of maintenance.

Modifications can be envisaged. The motor of the carriage can be a step motor, or a direct current motor or a brushless motor. The positioning sensors, instead of an optical type, can be of a mechanical type or proximity type. The print head, instead of a needle or type-bar printer, can be of a impact, ink-jet, thermic, thermic transfer or optical type. The electronic circuit can be made by means of active or passive standard components or single digital or analog chips, large scale integration power components.

The invention claimed is:

1. A semiautomatic electronic printer, comprising a housing (2) that can be positioned on the surface of a medium to be printed and remain stationary during a print sequence, a large push-button (3) located in the upper part of the housing (2) and movable with respect to same housing (2), a print head (8) being provided with proper printing means and positioned inside the housing (2), and electronic control means disposed in the housing (2) and adapted to acquire data to be printed from a separated computer and to store such data, as well as adapted to control the operation of the print head (8), characterised in that the semiautomatic electronic printer comprises, as a moving unit (5) inside the housing (2):

the large push-button (3);

at least a switch (15, 16) for controlling the printing, disposed on said moving unit (5) and activated by the movement of the moving unit with respect to the housing (2);

a frame (7), being rigidly connected to said push-button (3) and mounted, in a spring-charged relationship, inside said housing (2) in such a manner to be vertically movable between two positions, the one being upper or rest position and the other being lower or work position, such lower position being reached and maintained at least for the time necessary to execute the printing operation;

a powered carriage (20), sustained, in its upper part, by said frame (7) and adapted to transport a print head (8) for a predefined printing travel, and controlled by the electronic control means;

the print head (8), rigidly connected to said carriage (20) with its printing means being disposed in the lower part and brought near said medium to be printed in the printing operation; and a printed circuit board (6) sustained in its upper part by said frame (7), including said electronic control means.

2. A printer according to claim 1, characterised in that on said push-button (3) a manual force can be exerted against the bias of counteracting springs (11), abutted between the frame (7) and a support rigidly connected to the housing (2), which, without such a force, bring the push-button (3) and all the moving unit (5) associated thereto in the rest position.

3. A printer according to claim 1, characterised in that on said printed circuit board (6) at least an electromagnet (37) is provided able to exert a balanced force against the bias of counteracting springs (11), abutted between the frame (7) and a support rigidly connected to the housing (2), which, without such a force, bring the push-button (3) and all the moving unit (5) associated thereto in the rest position.

4. A printer according to claim 1, characterised in that said carriage (20) is mounted movable to said frame (7) through horizontal sliding couplings by means of a powered operation group (18, 19).

5. A printer according to claim 4, characterised in that said powered operation group (18, 19) comprises a worm screw transmission (19), a nut screw (21) being connected to said carriage (20).

6. A printer according to claim 1, characterised in that at least one sensor is mounted on said printed circuit board (6) as a reference of an initial position of the carriage (20).

7. A printer according to claim 1, characterised in that the print head (8) is provided of its own ink feeder cartridge (26).

8. A printer according to claim 7, characterised in that on the printed circuit board (6) there is a sensor able to detect the presence of said cartridge (26).

9. A printer according to claim 1, characterised in that said push-button (3) is made of a semitransparent material adapted to the transmission of light indications from displays located on the printed circuit board (6).

10. A printer according to claim 1, characterised in that a gripping handle (35) of the printer projects from a side of said housing (2).

11. A printer according to claim 1, characterised in that an entrance (32) for a cable of connection with an electronic processing apparatus is provided on a side of said housing (2).

12. A printer according to claim 1, characterised in that said housing (2) has frontal and lateral transparent windows (4) for watching the printing zone.

13. A printer according to claim 1, characterised in that at least a light source (36) for illuminating a printing zone is underneath the printed circuit board (6), facing the printing zone.

14. A printer according to claim 1, characterised in that a horn (39) is provided on said printed circuit board (6).

15. A printer according to claim 1, characterised in that an inclinometer (38) is provided on said printed circuit board (6) to check a working position of the printer.

* * * * *